United States Patent [19]

Spevak

[11] 4,342,492

[45] Aug. 3, 1982

[54] PORTABLE ARTICLE SUPPORTING CONTAINER

[75] Inventor: Steven T. Spevak, Derwood, Md.

[73] Assignee: Potomac Applied Mechanics, Inc., Bethesda, Md.

[21] Appl. No.: 118,633

[22] Filed: Feb. 4, 1980

Related U.S. Application Data

[63] Continuation-in-part of Ser. No. 38,719, May 14, 1979, Pat. No. 4,286,832, which is a continuation-in-part of Ser. No. 907,321, May 18, 1978, Pat. No. 4,170,392.

[51] Int. Cl.[3] ..... A47B 97/00; A47B 81/00

[52] U.S. Cl. ..... 312/244; 190/16; 206/373; 211/169; 220/23; 220/335; 312/138 A; 312/283; 312/305; 312/DIG. 33

[58] Field of Search ..... 312/DIG. 33, 283, 138 A, 312/285, 305, 244; 220/23, 335; 206/372, 373; 211/169; 223/107, 108; 190/16

[56] References Cited

U.S. PATENT DOCUMENTS

| | | | |
|---|---|---|---|
| 620,013 | 2/1899 | Barnes | 312/283 |
| 1,785,338 | 5/1930 | Simos | 220/23 |
| 2,589,370 | 3/1952 | Grennan . | |
| 2,641,520 | 6/1953 | Moore | 312/DIG. 33 |
| 3,352,390 | 11/1967 | Zalkind | 190/16 |
| 3,578,153 | 5/1971 | Olson | 220/23 |
| 4,170,392 | 10/1979 | Spevak | 312/283 |

*Primary Examiner*—Alexander Grosz

*Attorney, Agent, or Firm*—Cushman, Darby & Cushman

[57] ABSTRACT

A portable article supporting container is provided that allows access to one portion thereof without requiring the entire container to be opened, and when the entire container is opened one portion supports the other for ease of use. First and second container portions are pivotally mounted together for movement from a first position wherein the container is closed, to a second position wherein it is opened. One latch effects latching of the container portions in the closed position while another latch effects latching in the open position. A pair of article supporting plates are provided which are operatively pivotally connected to the container first portion so that the plates may be moved from a first position contained within the volume of the first container portion to a second position wherein they extend outwardly from that volume substantially perpendicular to a plane containing the container first portion. The article supporting plates comprise an exterior wall of the container first portion, and they may be mounted for rotation with respect to the container first portion and for pivotal movement with respect to a center structure mounted by the container first portion. The of the container second portion is designed with respect to the first portion so that when the container is open with the container second portion resting on a horizontal surface, the first portion will be supported by the second portion without tipping over.

19 Claims, 6 Drawing Figures

PORTABLE ARTICLE SUPPORTING CONTAINER

CROSS REFERENCE TO RELATED APPLICATION

This application is a continuation-in-part of application Ser. No. 38,719 filed May 14, 1979, now U.S. Pat. No. 4,286,832, which application in turn is a continuation-in-part of application Ser. No. 907,321 filed May 18, 1978, now U.S. Pat. No. 4,170,392.

BACKGROUND AND SUMMARY OF THE INVENTION

In parent application Ser. No. 38,719, filed May 14, 1979 now U.S. Pat. No. 4,286,832 (the disclosure of which is hereby incorporated by reference herein), a practical, versatile, efficient article supporting assembly is provided that makes maximum use of the available space and supports articles associated therewith in a manner such that they may be readily seen and removed. Accordingly to the present invention, a further variation is provided of an article supporting assembly that is designed to make efficient use of this space, support the articles so that they may be readily seen and removed, and provide great versatility of use. The portable article supporting container according to the present invention is especially advantageous in that it allows access to a certain number of articles supported thereby in a convenient, simple, manner that does not require opening the entire container; while at the same time having a great container volume and once the container is completely opened utilizes one portion thereof to support another portion so that all of the articles contained thereby are readily accessible.

According to the present invention, a portable article supporting container is provided which comprises a first container portion including first, second, third and fourth walls (the first wall being opposite the third wall and the second wall opposite the first wall), and a second container portion including first, second, third and fourth walls. Means are provided for pivotally mounting the first and second container portions together along the first walls thereof for movement from a first position wherein the walls of the respective container portions are substantially coplanar, to a second position wherein the walls of the respective container portions are substantially perpendicular to each other. First latch means are provided for latching the container portions in the first position thereof, and second latch means are provided for latching them in the second position thereof. A pair of article supporting plates are provided which article supporting plates are the readily accessible portions of the container. Means are provided for operatively pivotally connecting the article supporting plates to the container first portion so that the plates may be moved from a first position substantially contained within the volume define by the first through fourth walls of the first container portion, to a second position wherein the plates extend outwardly from the volume substantially perpendicular to a plane containing the first container portion first through fourth walls. Preferably, the article supporting plates defined, in the first position thereof, a fifth wall of the first container portion, the fifth wall being on the opposite side of the wall of the first container as the container second portion.

The means for operatively pivotally connecting the article supporting plates to the container first portion preferably comprise a structure such as illustrated in parent application Ser. No. 38,719 filed May 14, 1979, now U.S. Pat. No. 4,286,832. In particular, a center structure attached to at least one of the first through fourth walls of the first container portion is provided, at least two spanners, first hinges for connecting the article supporting plates to the spanners, and second hinges for connecting the spanners to the center structure. The center structure is preferably mounted for rotation about an axis extending between the first and third walls of the first container portion. Alternatively, or in addition, article supporting plates may be provided with means for operatively pivotally connecting them to the container first portion including a center structure attached to at least one of the first container first through fourth walls, a support member rigidly attached to and extending substantially perpendicular from the center structure, and hinge means for pivotally mounting both of the article supporting plates to the support member.

The second container portion is substantially larger and heavier than the first container portion so that when the first container portion is in the second position thereof with respect to the second container portion, with a vertical plane containing each of the second container portion first through fourth walls, the first portion will be supported by the second portion without tipping over.

The second latch means may comprise a locking hinge assembly having first and second levers pivotally mounted to the first and second containers, respectively, at one end thereof, and pivotally mounted to each other adjacent another end thereof. An opening is formed in one of the levers for cooperation with a spring loaded latching member mounted on the other lever so that when the levers are brought into overlapping position an end of the latching member penetrates the opening to hold the levers together. Cam means are formed on the end of the latching member for effecting movement thereof when the levers are brought into overlapping position. Two such locking hinge assemblies are provided connected to the second and fourth walls of the first and second container portions respectively. The second container portion includes a fifth solid wall rigidly connected to the first and fourth walls and extending perpendicular thereto, disposed on the opposite side of the first through fourth walls as the container first portion. A handle is mounted to the second container third wall portion, and interior metal supporting frames are provided for both the first and second container portions for supporting the walls thereof.

It is the primary object of the present invention to provide a versatile and efficient portable article supporting container. This and other objects of the invention will become clear from an inspection of the detailed description of the invention and from the appended claims.

DETAILED DESCRIPTION OF THE DRAWINGS

Figure 1:
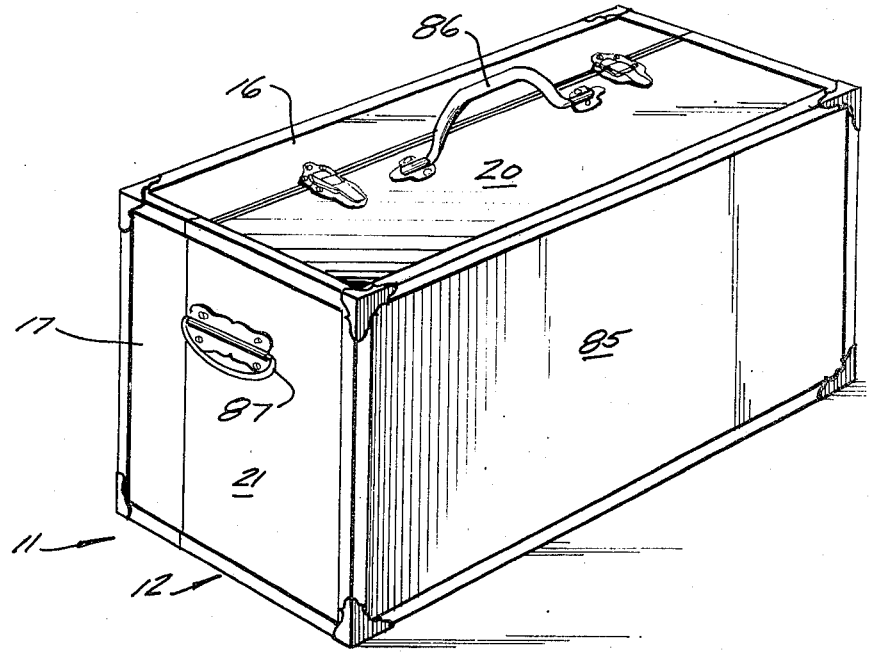
FIG. 1 is a perspective view of an exemplary container according to the present invention, looking in at the second container portion thereof.

An exemplary portable article supporting container according to the present invention is shown generally at 10 in the drawings. The container 10 includes a first container portion 11, and a second container portion 12. The first container portion 11 includes a first wall 14, second wall 15, third wall 16, and fourth wall 17, while the second container portion 12 comprises a first wall 18, second wall 19, third wall 20, and fourth wall 21. The container portions 11, 12 can be made of any suitable material. Where the material of which they are constructed is relatively light or has insufficient structural integrity, it is desirable to provide an interior metal supporting frame 23, 24 disposed in each of the portions 11, 12 respectively, for supporting the first through fourth walls, respectively, thereof.

Figure 3:
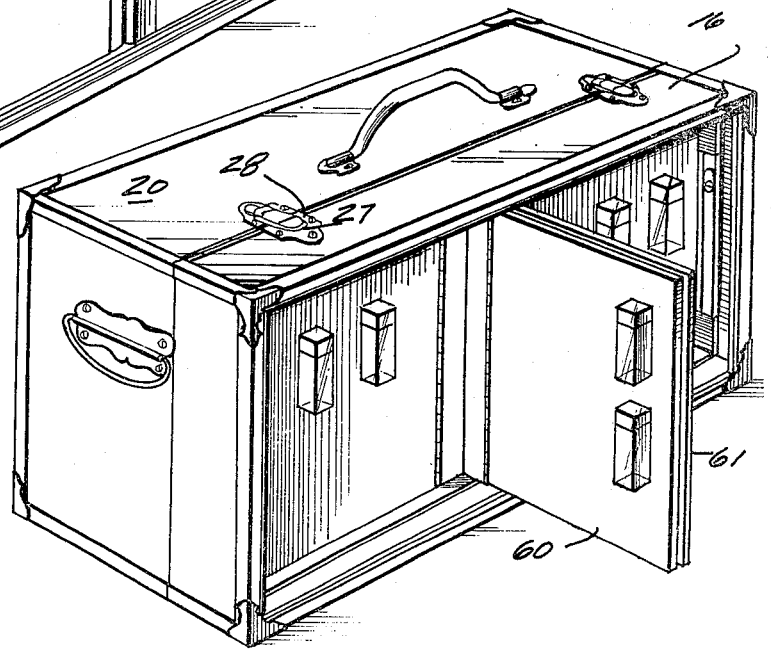
FIG. 3 is a perspective view like FIG. 2 only showing the article supporting plates in an extended position thereof.
Figure 4:
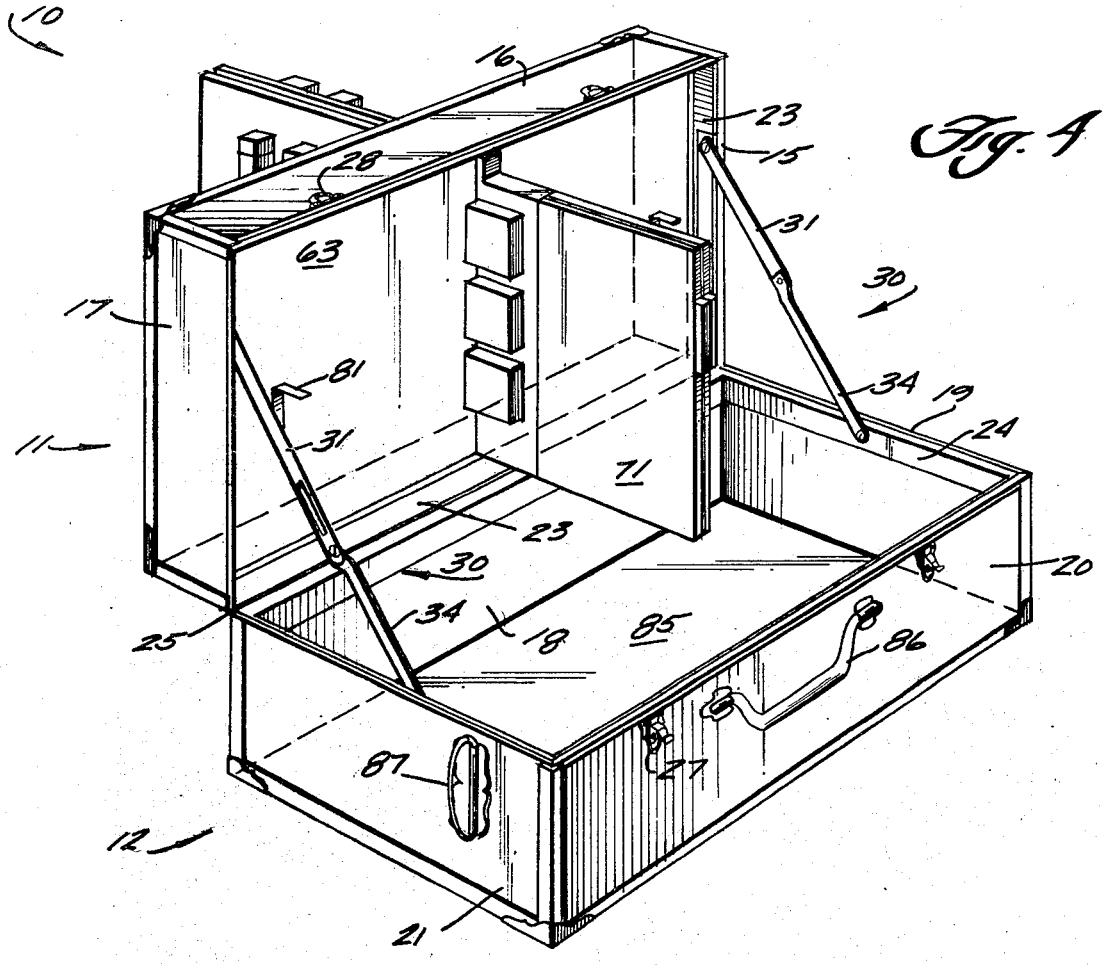
FIG. 4 is a perspective view of the container of FIG. 1 in the open position, with article supporting plates associated with the first portion extended.
Figure 6:
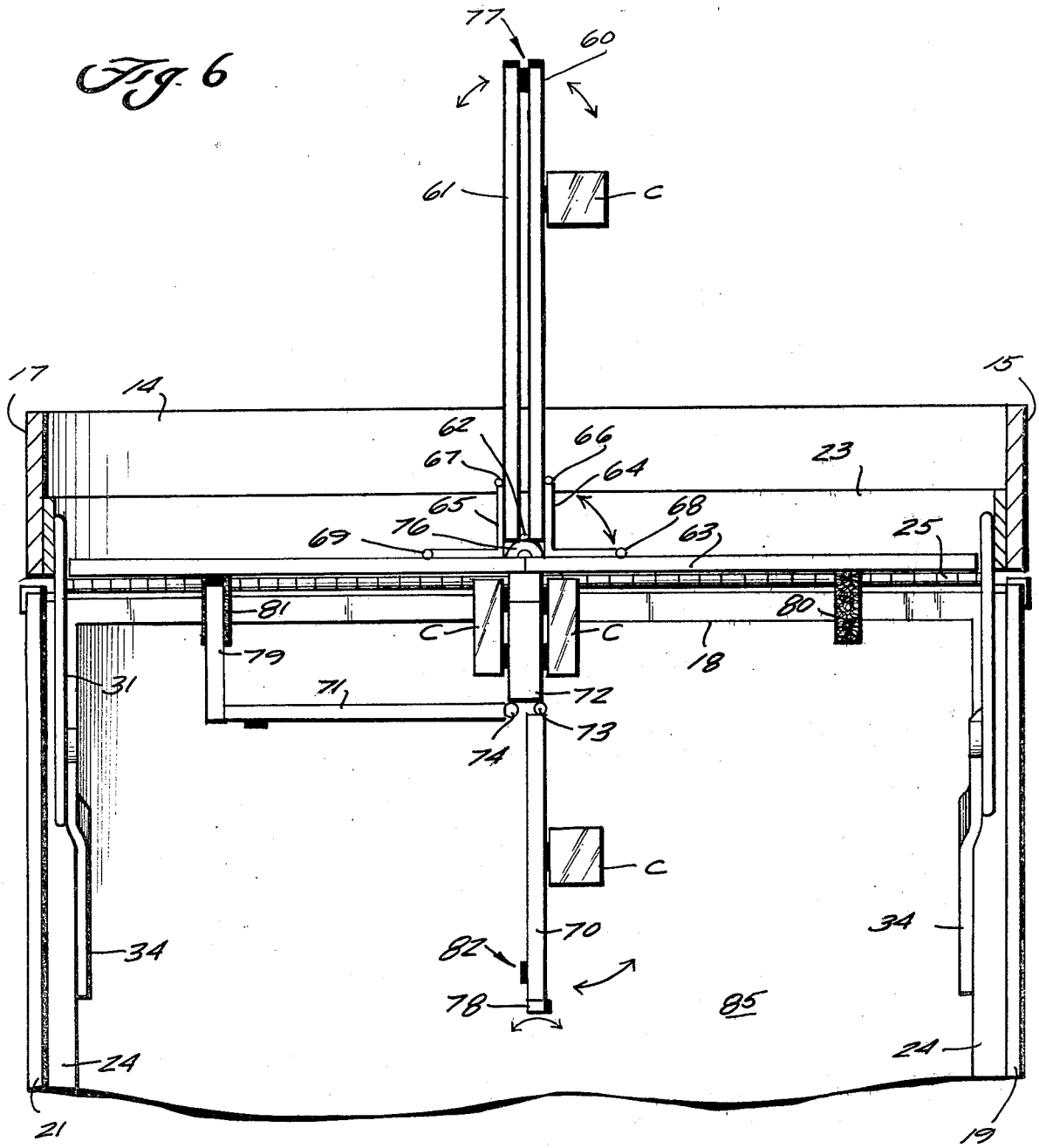
FIG. 6 is a top view, partly in cross-section and partly in elevation, illustrating the article supporting plates and the like associated with the first container portion, and showing such mechanisms while the container is in the open position.

The container 10 further comprises means for pivotally mounting the first and second container portions together along the first walls 14, 18, for movement from a first position (FIGS. 1 and 2) wherein the first through fourth walls of the respective container portion are substantially coplanar, to a second position (FIGS. 4 and 6) wherein the first through fourth walls of the respective container portions 11, 12 are substantially perpendicular to each other. Such pivotally mounting means preferably takes the form of a conventional hinge or hinges 25 connected to each of the walls 14, 18. The container 10 further comprises first latch means for latching the portions 11, 12 in their first, closed position (FIGS. 1 through 3), and second latch means for latching them in their second, open position (FIGS. 4 and 6). The first latch means may take the form of conventional pivotal clasps 27 or the like disposed on wall 20, for cooperation with stationary clasp-engaging portions 28 mounted to wall 16. The second latch means may take the form of at least one locking hinge assembly, shown generally at 30 in the drawings.

Figure 5:
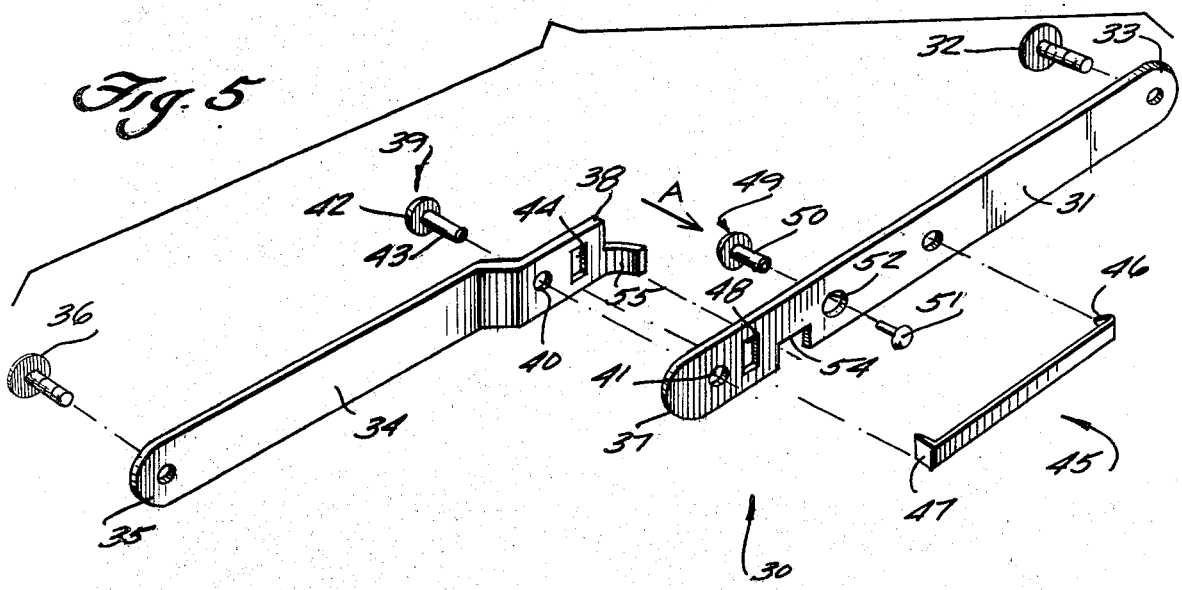
FIG. 5 is an exploded perspective view of an exemplary latching structure for holding the container portions in open position.

A preferred locking hinge assembly 30 according to the present invention is illustrated most clearly in FIGS. 4 and 5. The assembly 30 includes a first lever 31 pivotally mounted (as with screw 32) at a first end 33 thereof to the first container portion 11 (e.g. to internal metal frame 23 at wall 15), and a second lever 34 pivotally mounted at a first end 35 thereof, as by screw 36, to the second container portion 12 (as to internal metal frame 24 at wall 19). Means are provided for pivotally mounting the first and second levers together adjacent corresponding second ends 37, 38, respectively thereof. Such pivotal mounting means may include a rivet 39 which passes through corresponding openings 40, 41 in the levers 34, 31, respectively, the rivet 39 having one preformed head 42, and another head being formed from the shaft 43 thereof after it is passed through the openings 40, 41. An opening 44 is formed in one of the levers (the lever 34 in FIG. 5), and a spring loaded latching member 45 is mounted to the other of the levers (lever 31 in FIG. 5). The latching member 45 preferably comprises a leaf spring rigidly affixed at one end 46 thereof to the lever 31, with the end 47 thereof being free.

The inherent resilience of the leaf spring 45 normally causes the projection 47 to pass through the opening 48 in the lever 31 and through the opening 44 in lever 34, causing the levers to be locked together in an in-line position (see FIG. 4). Cam means are formed on the projection 47 so that as the levers 31, 34 are moved into overlapping relationship the top side edge of the lever 34 engages the cam means on the projection 47 causing the projection 47 to be cammed out of the way of the lever 34 until it is received by the opening 44.

In order to release the latching projection 47 from the opening 44 when it is desired to closed the container 10, a release button 49 is provided. One portion 50 of the release button may have a female component and a head, while the other portion 51 of the release button 49 has a male component and a head so that the release button passes through the opening 52 formed in lever 31 with a head on either side thereof. The release button 49 is longer than the width of the lever 31, and when it is depressed in direction A it moved the leaf spring 45 so that the projection 47 thereof moves out of interengagement with the opening 44. The levers 31, 34 further comprise a cooperating cut-out 54 and tongue 55 to support the projection 47 in holding the levers 31, 34 together in their in-line position (see FIG. 4).

Figure 2:
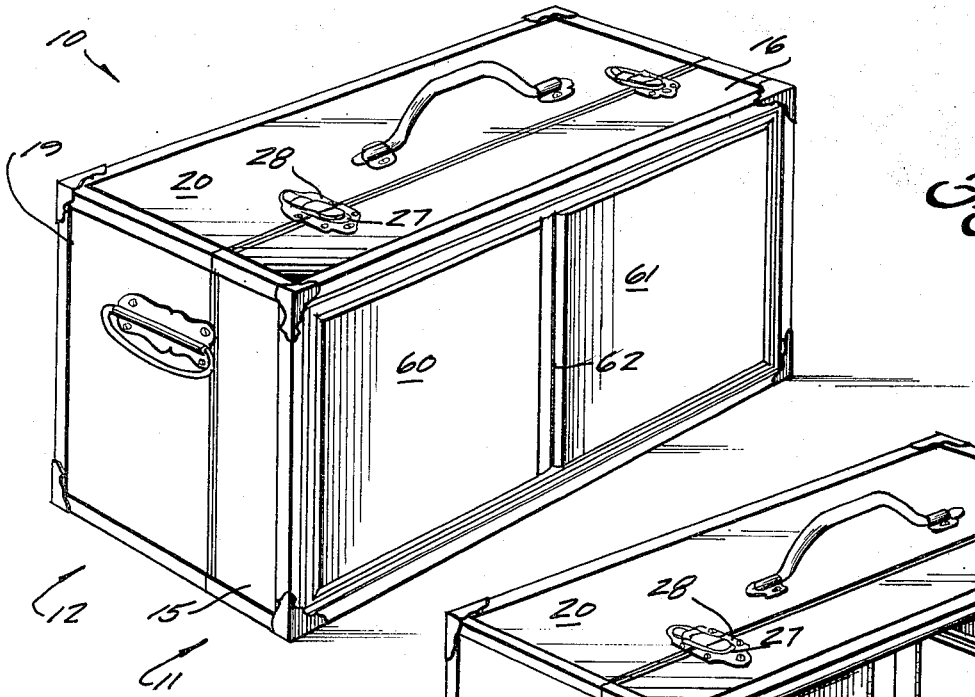
FIG. 2 is a perspective view like FIG. 1 only looking in at the first container portion thereof.

The container 10 further comprises sets of article supporting plates, including at least article supporting plates 60, 61. The plates 60, 61 may have any suitable article attaching means formed or disposed thereon, such as hooks, clips, hook and loop type fasteners such as those sold under the trademark "Velcro" and in the form of strips or coverings, or the like. The plates 60, 61 comprise a fifth wall of the first container portion 11, as illustrated in FIG. 2.

Means are provided for operatively pivotally connecting the plates 60, 61 to the container portion 11 so that the plates may be moved from a first position substantially contained within the volume defined by the container portion 11 (FIG. 2), to a second position (FIG. 3) wherein the plates 60, 61 extend outwardly from the volume substantially perpendicular to a plane containing the walls 14 through 17. Such connecting means preferably comprise an assembly such as shown in parent application Ser. No. 38,719 filed May 14, 1979, now U.S. Pat. No. 4,286,832 and in U.S. Pat. No. 4,170,392. Such an arrangement includes a center structure (e.g. center plate) 63 operatively attached to at least one of the walls 14 through 17; at least two spanners 64, 65 (see FIG. 6); first hinges 66, 67 for connecting the plates 60, 61 to the spanners 64, 65 so that they are pivotal with respect thereto; and second hinges 68, 69 for connecting the spanners 64, 65 respectively to the center structure 63 so that the spanners 64, 65 are pivotal with respect to the center structure 63. The plates 60, 61 are also pivotally connected together by hinge means 62 along one edge thereof.

Alternatively, or preferably in addition to, article supporting plates 70, 71 are provided with the means for attaching such plates to the container portion 11 including the center structure 63, a support member 72 rigidly attached to and extending substantially perpendicularly from the center structure 63, and hinge means—such as hinges 73, 74—for pivotally mounting both of the article supporting plates 70, 71 to the support member 72.

As illustrated in FIG. 6, the plates 60, 61 may comprise an exterior wall of the container portion 11, while the plates 70, 71 are disposed interiorly thereof; or the opposite may be the case, or both sets of article supporting plates may be formed and supported like the plates 60, 61.

Preferably the center structure 63 is mounted for rotative movement with respect to the container portion 11. Preferably the axis of rotation thereof extends perpendicular to the walls 14, 16, as illustrated most clearly in FIGS. 4 and 6. The rotative means may comprise a different lazy susan 76 (see FIG. 6) mounted to the wall 14, or any other suitable arrangement.

A structure also is desirably provided for holding the plates 60, 61 and 70, 71 to the positions to which they have been moved. In the case of the plates 60, 61 cooperating magnets or hook and loop type fasteners, indicated generally at 77 in FIG. 6, may be provided for holding the plates 60, 61 in the second position thereof (FIG. 6); any suitable latching means, such as shown in parent application Ser. No. 38,719 filed May 14, 1979 or U.S. Pat. No. 4,170,392 may be provided, however.

In the case of the plates 70, 71 locating means for positively locating the plates in the first positions (plate 71 in FIG. 6) thereof so that they will not pivot with respect to the center structure 63 without release of the locating means include levers 78, 79 and holding means 80, 81. The levers 78, 79 are pivotally mounted to the side edge of the plates 70, 71 for rotation about an axis coplanar with the plates 70, 71 respectively and parallel to the axis of the hinge means 73, 74. The holding means 80, 81 may comprise tabs rigidly secured to the center structure 63, and cooperating hook and loop type fasteners may be provided on engaging surfaces of the levers 78, 79 and tabs 80, 81 to hold the levers 78, 79 in place when they extend substantially perpendicularly to the plates 70, 71 (see lever 79 in FIG. 6). For holding the plates 70, 71 in their second position (see plate 70 in FIG. 6) cooperating magnets or hook and loop type strips, such as indicated generally at 82, may be provided.

The second container portion 12 is preferably substantially larger and heavier than the first container portion 11 so that when the portion 11 is in the second position (FIG. 4) thereof with respect to the portion 12, with a vertical plane containing the walls 18 through 21 of the portion 12, the portion 11 will be supported by the portion 12 without tipping over. Alternatively, or in addition, this may be facilitated by dimensioning the portion 11 so that portions of the walls 14 through 17 thereof are actually disposed within the container second portion 12 when the container portions are in the first position (FIG. 1) thereof, mounting the hinge 25 to a middle portion of the wall 14 of container portion 11.

The second container portion 12 further comprises a fifth solid wall 85 (see FIG. 1) extending perpendicular to the walls 18 through 21 and disposed on the opposite side of the walls 18 through 21 as the first container portion 11. Further, a handle 86 is provided mounted to the wall 20, and preferably having fastening components extending therethrough into the metal interior frame 24 so that good support is provided for the handle 86. Additionally accessory handles 87 may be provided on the walls 19, 21, if desired.

While the structures 60, 61, 70, and 71 have been described as article supporting plates, other components associated with the container 10 also can have provisions for the support of articles. For instance, commonly the center structure 63 would be formed with article supporting structures, as would the support member 72, having article supporting means for supporting articles C or the like. Further, the interiors of the walls 18 through 21 and 85 of the second portion 12 may likewise be provided with article supporting means, although any such article supporting means thereon will normally be provided for supporting much heavier articles than are supported by the article supporting portions of the first container portion 11.

In use of the container 10 according to the present invention, articles that are most commonly needed are mounted on the article supporting plates 60, 61, and the face of center structure 63 adjacent the plates 60, 61. When it is desired to gain access to such articles without opening up the entire container 10, an individual merely pivots the plates 60, 61 about hinge 62 and spanners 64, 65 from the closed position thereof illustrated in FIG. 2, to the open position as illustrated in FIG. 3. In situations where access is required only to articles located in the second portion 12 of the container 10, the plates 60, 61 are left in the first position thereof illustrated in FIG. 2, the first latch means 27, 28 are released, and the portion 11 is pivoted about hinge 25 to a perpendicular orientation (see FIG. 4) with respect to the portion 12, the second latch means 30 holding the portions 11, 12 in place in that position.

In situations where access is desired to all components within the container 10, the plates 60, 61 are moved to the second position thereof (FIGS. 3, 4, and 6), the container portions 11, 12 are moved to the second position thereof (FIGS. 4 and 6), the levers 78, 79 are pivoted upwardly and the plates 70, 71 are then moved to the second position thereof (FIG. 4). By rotating the center structure 63 about the rotatable mounting structure 76, access is readily gained to all of the articles supported by the plates 70, 71, 60, 61, and center structure 63.

In order to close up the container 10 once it has been opened, the plates 70, 71 are pivoted back to their first position (see plate 71 in FIG. 6) and the levers 78, 79 pivoted downwardly to engage the tabs 80, 81. The plates 60, 61 are pivoted back to their first position (see FIG. 2). The release buttons 49 associated with the levers 31 of the hinge assembly 30 are depressed causing the projections 47 of the leaf springs 45 to move out of the openings 44 and thus allowing the levers 31, 34 to pivot about pivot means 39 to the collapse position (with the container portions 11, 12 assuming the position illustrated in FIG. 1 or 2). The first latch means 27, 28 are then again done up, and one can readily transport the container 10 from place to place utilizing the handle 86 or the handles 87.

While the terms "plate," "wall" and "spanner" are sometimes used to describe various components, such terms should be interpreted broadly, and are not restricted to only thin, completely flat, continuous members. For instance, such members may be segments, have a curvature, and have different shapes than illustrated in the drawings, the representations in the drawings being only exemplary. In general, while the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A portable article supporting container comprising a first container portion including first, second, third and fourth walls, said first wall being opposite said third wall and said second wall opposite said first wall;

a second container portion including first, second, third and fourth walls corresponding to said first container portion walls;

means for pivotally mounting said first and second container portions together along said first walls for movement from a first position wherein said first, second, third and fourth walls of each respective container portion are substantially coplanar with the respective corresponding walls of the other container portion, to a second position wherein said first, second, third and fourth walls of each respective container portion are substantially perpendicular to the respective corresponding walls of the other container portion;

first latch means for latching said container portions in said first position;

second latch means for latching said container portions in said second position;

a pair of article supporting plates accessible from the exterior of said first container portion;

means for operatively pivotally connecting said article supporting plates to said first container portion so that access to said plates is provided from the exterior of said first container portion when in said first position with respect to said second container portion so that said plates may be pivotally moved about an axis passing through two opposite walls of said first container portion, from a first position substantially within the volume defined by said first container portion first, second, third and fourth walls, to a second position wherein said plates extend outwardly from said volume.

2. A container as recited in claim 1 wherein said pair of article supporting plates define, in said first position, a fifth wall of said first container portion, and wherein said fifth wall is on the opposite side of said first container portion first, second, third, and fourth walls as said container second portion.

3. A container as recited in claim 2 wherein said means for operatively pivotally connecting said article supporting plates to said container first portion comprise: a center structure attached to at least one of said first, second, third, and fourth first container portion walls; at least two spanners, first hinges for connecting said article supporting plates to the spanners so that said plates are pivotal with respect to the spanners; and second hinges for connecting the spanners to the center structure so that the spanners are pivotal with respect to the center structure.

4. A container as recited in claim 3 wherein said center structure comprises a center plate, said center plate, when said article supporting plates are in said first position, being perpendicular to each of said first, second, and third walls of said container first portion.

5. A container as recited in claim 4 further comprising means for mounting said center plate for rotation about an axis extending between opposite ones of said container first portion first, second, third, and fourth walls.

6. A container as recited in claim 5 wherein said axis of rotation of said center plate extends between said first container portion first and third walls.

7. A container as recited in claim 1 wherein said means for operatively connecting said article supporting plates to said container first portion include means for mounting said article supporting plates so that in said second position thereof they extend parallel to said first container portion second and fourth walls, and perpendicular to planes containing said first container portion first and third walls respectively.

8. A container as recited in claim 1 wherein said means for operatively pivotally connecting said article supporting plates to said container first portion comprise a center structure attached to at least one of said first container portion first, second, third and fourth walls; a support member rigidly attached to and extending substantially perpendicularly from said center structure; and hinge means for pivotally mounting both of said article supporting plates to said support member.

9. A container as recited in claim 8 further comprising locating means for positively locating said article supporting plates in said first position thereof so that they will not pivot with respect to said center structure without release of said locating means, said locating means comprising a lever associated with each article supporting plate and pivotally attached to one of said center structure and its respective article supporting plate; and a holding means associated with the other of said center structure and said respective article supporting plate for releasably holding said lever thereto so that it extends substantially perpendicularly to said article supporting plate and said center structure, engaging both.

10. A container as recited in claim 8 further comprising article supporting means located on said center structure and said support member.

11. A container as recited in claim 10 further comprising means for mounting said center structure for rotation with respect to said container first portion.

12. A container as recited in claim 1 wherein said second latch means comprise at least one locking hinge assembly, said locking hinge assembly including a first lever pivotally mounted at a first end thereof to said first container portion; a second lever pivotally mounted at a first end thereof to said second container portion; means for pivotally mounting said first and second levers together adjacent corresponding second ends thereof; an opening formed in one of said levers; a spring loaded latching member mounted on the other of said levers and positioned thereon so that an end thereof passes through said opening when said first and second levers are brought into overlapping position to hold the levers together; and cam means formed on the end of said latching member for effecting movement of said latching member so that it can penetrate said opening as said first and second levers are brought into overlapping position.

13. A container as recited in claim 12 wherein two of said locking hinge assemblies are provided, each having first and second levers connected to said first container portion and said second container portion, respectively.

14. A container as recited in claim 1 wherein said second container portion comprises a fifth solid wall rigidly connected to said first, second, third, and fourth walls thereof, said fifth solid wall extending perpendicular to each of said first, second, third, and fourth walls thereof, and disposed on the opposite side of said second container portion first, second, third and fourth walls as said container first portion.

15. A container as recited in claim 1 further comprising a handle mounted to said second container portion third wall.

16. A container as recited in claim 1 wherein said first latch means comprises cooperating latch structures disposed on said first and second container portions third walls.

17. A container as recited in claim 1 further comprising an interior metal supporting frame disposed in each of said container first and second portions and supporting each of said first, second, third, and fourth walls thereof.

18. A container as recited in claim 1 wherein said means for operatively pivotally connecting said article supporting plates to said container first portion comprise: a center structure; means for mounting said center structure for rotation about an axis passing through said first container portion first and third walls; at least two spanners; first hinges for connecting said article supporting plates to the spanners so that said plates are pivotal with respect to the spanners; and second hinges for connecting the spanners to the center structure so that the spanners are pivotal with respect to the center structure; and wherein said container further comprises a second set of article supporting plates; and means for mounting said second set of article supporting plates so that they are moveable with respect to said center structure from a first position wherein they are contained within the volume defined by said first container portion first, second, third and fourth walls, to a second position wherein they extend outwardly from said volume substantially perpendicular to said center structure, said mounting means including means for operatively pivotally mounting said second set of plates to said center structure.

19. A container as recited in claim 18 wherein said means for mounting said second set of article supporting plates comprise a support member rigidly attached to and extending substantially perpendicularly from said center structure; and hinge means for pivotally mounting both of said article supporting plates to said support member.

* * * * *